United States Patent [19]

Jordan

[11] 4,192,432

[45] Mar. 11, 1980

[54] SIDEWALL CONSTRUCTION FOR SILVERWARE BASKET

[75] Inventor: Lawrence J. Jordan, Newton, Iowa

[73] Assignee: The Maytag Company, Newton, Iowa

[21] Appl. No.: 925,091

[22] Filed: Jul. 17, 1978

[51] Int. Cl.[2] ..... B65D 7/42; B65D 7/20

[52] U.S. Cl. ..... 220/83; 220/19; D9/248; 206/557

[58] Field of Search ..... 220/83, 84, 19, 72, 220/DIG. 15, 83; 206/557, 562, 564; 4/189, 190, 290; 211/41, 126; D9/246, 247, 248; D15/36

[56] References Cited

U.S. PATENT DOCUMENTS

| | | | |
|---|---|---|---|
| D 158,480 | 5/1950 | Long | D9/248 |
| 3,182,854 | 5/1965 | Geller | 220/83 |
| 3,288,155 | 11/1966 | Swetnam | 134/176 |
| 3,294,273 | 12/1966 | Ettlinger | 220/23.83 |
| 3,348,729 | 10/1967 | Ettlinger | 220/83 |
| 3,665,943 | 5/1972 | Lampman et al. | 220/83 X |
| 3,809,279 | 5/1974 | Arjas | 220/DIG. 15 X |
| 4,033,461 | 7/1977 | Nevai | 206/557 X |

*Primary Examiner*—Steven M. Pollard
*Attorney, Agent, or Firm*—Richard L. Ward

[57] ABSTRACT

A dishwashing apparatus which includes a generally perforate silverware basket for holding silverware during washing, rinsing and drying operations. The basket side and end walls include vertical and diagonal intersecting ribs forming a lattice-work of perforations which promotes natural, gravitational drainage of washing fluid from the walls.

2 Claims, 10 Drawing Figures

SIDEWALL CONSTRUCTION FOR SILVERWARE BASKET

BACKGROUND OF THE INVENTION

Field of the Invention

This invention relates generally to the field of dishwashers and more particularly to silverware baskets therefor.

In the field of dishwashing apparatus where the dishes and silverware are dried within the dishwashing apparatus, the retention of washing fluid on the peripheral walls of the silverware basket as on ledges, in pockets, or by bridging of the wall perforations hinders drying of the silverware.

Geller, in U.S. Pat. No. 3,182,854, discloses a silverware basket having generally perforate walls. A plurality of conical spikes extend upwardly from the bottom wall of the basket. The spikes prevent the nesting of spoons and forks and tend to keep the silverware in a more nearly vertical posture within the basket. No mention is made of providing for removal of washing fluid from the basket surfaces.

Swetnam, in U.S. Pat. No. 3,288,155, discloses a silverware basket having imperforate side and end walls but with a perforate bottom wall. A special water distribution arrangement is provided to direct washing fluid into the basket. No provision is made, however, for removal of washing fluid from the basket surfaces.

Lampman et al, in U.S. Pat. No. 3,665,943, discloses a silverware basket which is removably mounted on the access door of the dishwashing apparatus. The front, back and bottom walls of the basket are perforate to allow washing fluid to enter the basket. Again, no mention is made of provisions for preventing retention of washing fluid on the surfaces of the basket.

SUMMARY OF THE INVENTION

It is an object of the instant invention to provide an improved silverware basket for use in a dishwashing apparatus.

It is a further object of the instant invention to provide a silverware basket which reduces the retention of washing fluid on the basket surfaces by promoting drainage therefrom.

It is a still further object of the instant invention to provide a silverware basket which enhances the drying capabilities of the dishwashing apparatus by reducing the amount of washing fluid which must be evaporated from the basket walls.

The instant invention achieves these objects in a silverware basket having perforate bottom and peripheral walls. The peripheral walls include a plurality of generally upstanding ribs and a plurality of downwardly sloping ribs intersecting and connected with the upstanding ribs to form a latticework of perforations around the basket. The ribs are constructed and disposed for draining washing fluid from the basket to reduce the retention of washing fluid on the walls.

Operation of the basket and further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
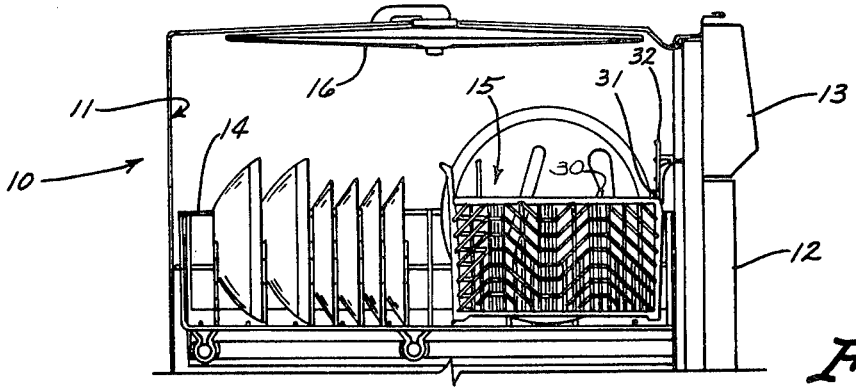
FIG. 1 is a partial vertical section view through the upper portion of a dishwashing apparatus showing the silverware basket in operational position.

There is shown generally in FIG. 1 a dishwashing apparatus 10. The dishwashing apparatus 10 includes a tub 11 forming a washing chamber and a door 12 for providing access to the washing chamber. The door 12 has a control panel 13 for housing a timer and various other control elements (not shown) for controlling the apparatus 10 through a prescribed cycle of operations including the washing, rinsing, and drying of dishes and silverware.

Located within the washing chamber are racks or baskets for loading dishes and silverware. In FIG. 1 the top rack 14 is shown with a molded plastic silverware basket 15 in the front center of the rack 14.

The top wash arm 16 shown in FIG. 1 directs a portion of the washing fluid downward into the silverware basket 15 and a bottom wash arm (not shown) directs a portion of the washing fluid upwardly into the silverware basket 15. The combined washing fluid from the upper and lower wash arms thus completely engulfs the silverware basket 15 and provides vigorous washing action to the exposed surfaces of the items contained therein.

Figure 2:
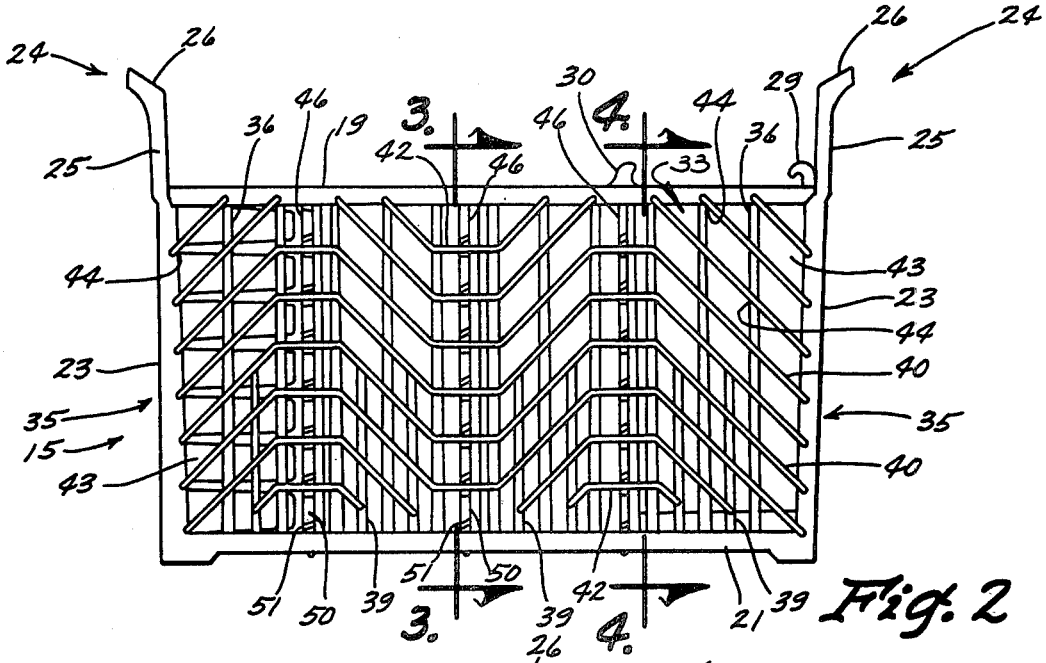
FIG. 2 is a side view of the silverware basket.
Figure 3:
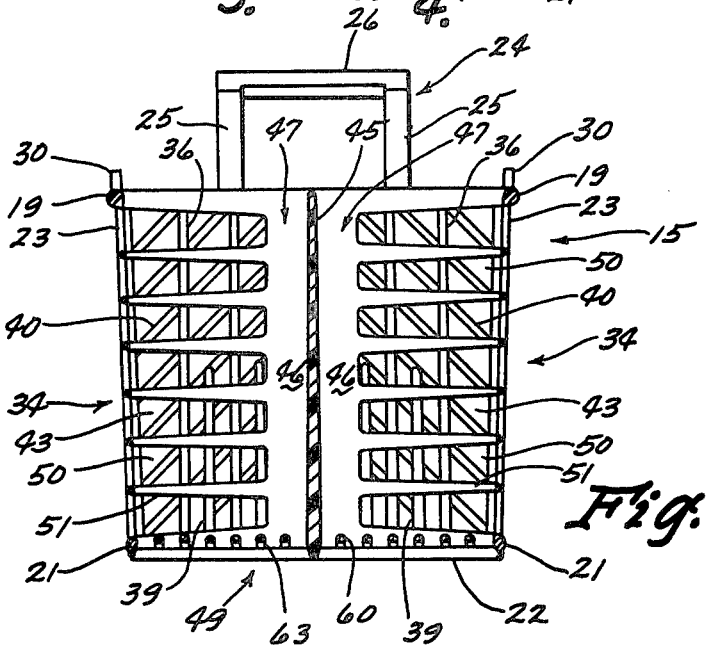
FIG. 3 is a sectional view taken along lines 3—3 of FIG. 2 showing interior construction of the silverware basket.
Figure 4:
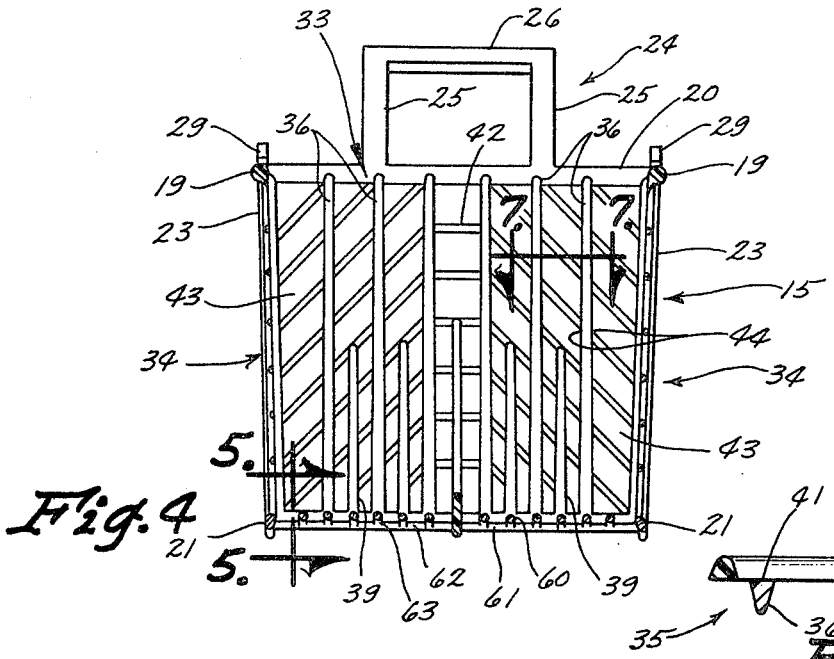
FIG. 4 is a sectional view taken along lines 4—4 of FIG. 2 showing end wall construction of the silverware basket.

The construction of the molded plastic silverware basket 15 is best shown in FIGS. 2–8. As FIGS. 2 and 4 show, the framework of the basket is comprised of top side and end rails 19 and 20 and bottom side and end rails 21 and 22 which extend the length and width of the periphery of the basket 15. The corners of the top and bottom rails 19–22 are joined by substantially vertical posts 23 of a generally rectangular cross section. The bottom of the basket 15 is both shorter in length and narrower in width than the top of the basket 15 so that the basket 15 is peripherally larger at the top than at the bottom.

FIGS. 2, 3 and 4 show a handle 24 at each end of the basket 15 for use in transporting the basket 15 from the dinner table to the dishwashing apparatus 10 or from the dishwashing apparatus 10 to the storage cabinet for loading and unloading of the basket 15. The handles 24 each have two spaced apart vertical columns 25 extending upwardly from the top end rail 20 and connected by a horizontal bar 26 at a distance above the top end rail 20 sufficient to permit a finger hold for picking up the basket 15.

As shown in FIG. 2, the right extremity of each of the top side rails 19 include a hook 29 and a catch 30. The hook 29 is radiused to accept the circular section 31 of a perforate, pivotal basket cover 32 shown in FIG. 1. The catch 30 is shaped to capture the end of the cover 32 for isolating a portion of the basket 15 to form a compartment 33 for washing light weight items which could be ejected from the basket 15 by the force of the washing fluid.

As shown in FIGS. 2 and 4, the side and end walls 34 and 35 are molded in a latticework arrangement to allow the ingress of washing fluid for cleansing the silverware while at the same time preventing the egress of silverware from the silverware basket 15.

Figure 7:
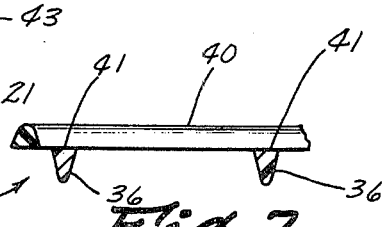
FIG. 7 is a fragmentary sectional view taken generally along lines 7—7 of FIG. 4.

As best shown in FIG. 4, the interior portion of each wall 34 or 35 includes a plurality of substantially vertical ribs 36 which taper from narrow at the top of the basket 15 to wider at the bottom. FIG. 7 shows a section through two of these ribs 36 and that the ribs 36 have the general shape of an equilateral triangle. The ribs 36 are tapered and shaped in this manner to facilitate removal of the basket 15 from the mold, and further, the tapered triangular shape promotes drainage of washing fluid from the vertical ribs 36.

Figure 10:
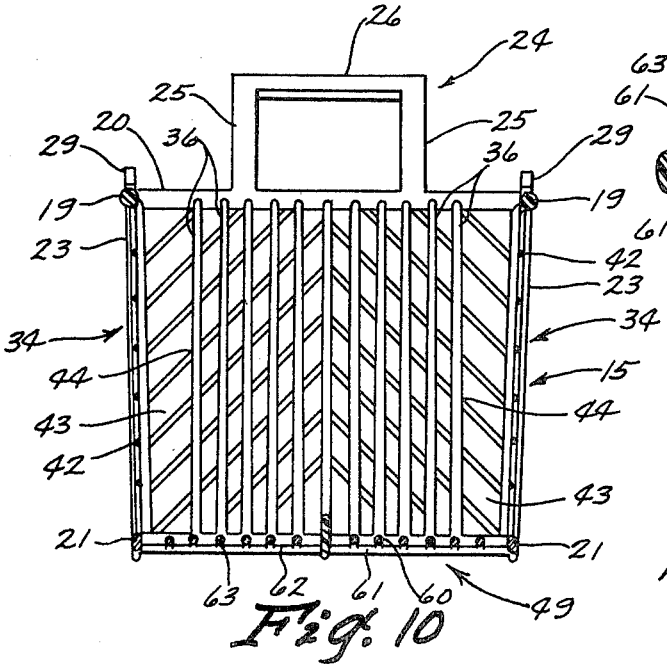
FIG. 10 is a view similar to FIG. 4 showing an alternate rib construction.

As indicated in the drawings, some of the vertical ribs 39 extend only part way up the side of the basket 15. These ribs 39 are necessary at the bottom of the basket 15 to provide narrowed openings which prevent the ends of the silverware items from extending through the sidewalls 34 and 35. Generally speaking, these ribs 39 are not needed in the top one-half of the basket 15. It is noted, however, that the basket 15 could be constructed with all of the vertical ribs 36 extending from the bottom to the top rails 20 to 22 as shown in the alternate construction of FIG. 10. The proposed construction saves a considerable amount of material over the alternate construction of FIG. 10.

Referring again to FIGS. 2 and 4, the exterior portion of the side and end walls 34 and 35 includes a second plurality of ribs 40 lying in a generally vertical plane which is parallel to the plane of the interior vertical ribs 36 and 39. The cross sectional shape of these exterior ribs 40 is also that of an equilateral triangle as shown in FIG. 7. FIG. 7 also shows that the parallel planes of the interior and exterior ribs 36, 39 and 40 actually touch at the points of rib intersection 40.

The exterior ribs 40 are molded so that they extend at an angle to either the vertical or horizontal. In the embodiment of FIGS. 1–8, a short portion 42 of the exterior ribs 40 is horizontal to aid in the removal of certain mold cores. As shown in the alternate construction of FIG. 10 the exterior rib sections 40 may be strictly diagonal without any horizontal portions 42. The diagonal construction of the outside ribs 40 tends to enhance the natural drainage of washing fluid from the silverware basket 15. Also, as shown in FIG. 7, the lines of intersection 41 between the parallel planes of the interior and exterior ribs 36, 39 and 40 are sharp edges or lines 41 to minimize the quantity of washing fluid retained. The openings 43 of the latticework side and end walls 34 and 35 also have sharp corners 44 to help prevent the washing fluid from bridging the corner 44 and thus further retard retention of washing fluid upon the walls 34 and 35 of the silverware basket 15.

The interior of the silverware basket 15 includes a plurality of vertical divider walls 45 and 46 which extend from top to bottom, side to side and end to end to form compartments 47 for separating silverware items within the basket 15. FIGS. 2 and 3 best show the construction of these interior dividing walls 45 and 46. As FIG. 3 shows, a central wall 45 divides the basket 15 lengthwise and is imperforate except for the perforate end section shown at the left in FIG. 2. As further shown in FIG. 2, on each side of the central imperforate wall 45 are three perforate wall sections 46 which combine with the side, end and bottom walls 34, 35 and 49 to form compartments 47 within the basket 15. As indicated in FIG. 3, the perforations in the interior walls 46 are substantially rectangular open portions 50 with bar shaped sections 51 which slope downwardly toward the side and end walls 34 and 35 of the basket 15. The perforations allow the washing fluid to flow freely between the compartments 47 within the silverware basket 15 and the sloping bar sections 51 allow washing fluid to naturally drain from the interior compartment walls 46.

The invention of the instant application is also disclosed in the application entitled "Silverware Basket Construction" filed as Ser. No. 925,212 on July 17, 1978 by Lawrence J. Jordan and assigned to the assignee of this application.

Figure 9:
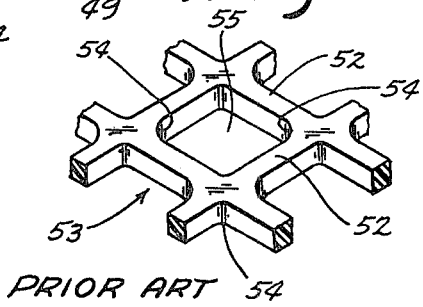
PRIOR ART Fig. 9
FIG. 9 is a perspective view showing prior art gridwork.

FIG. 9 shows a grid of ribs 52 taken from either a side or end wall which is typical of the general state of the art in silverware baskets. The intersecting ribs 52 are generally located in a single plane as shown in FIG. 9 and typically have radiused corners 54 which tend to promote the retention of washing fluid in the corner 54. When washing fluid becomes trapped in the corners 54, it is relatively easy for the washing fluid to completely bridge the perforation 55 and thus form a sheet of washing fluid which clings to the walls of the basket. The relatively large amount of washing fluid which can be retained by a plurality of perforations 55 usually will not fully evaporate in a normal drying operation and will result in wet silverware and/or dripping of washing fluid onto dry dishes during unloading of the dishwashing apparatus.

Figure 6:
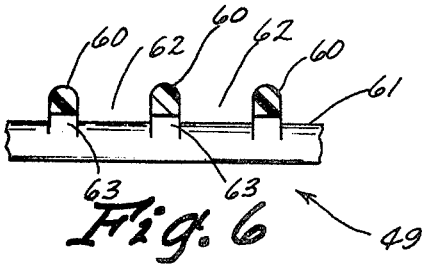
FIG. 6 is a fragmentary sectional view taken generally along lines 6—6 of FIG. 5.
Figure 5:
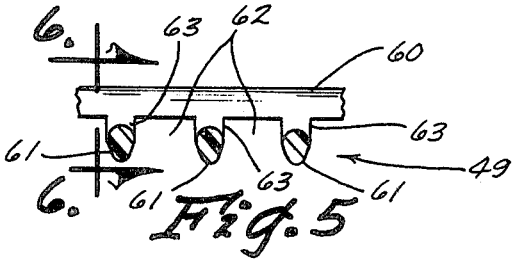
FIG. 5 is a fragmentary sectional view taken generally along lines 5—5 of FIG. 4.
Figure 8:
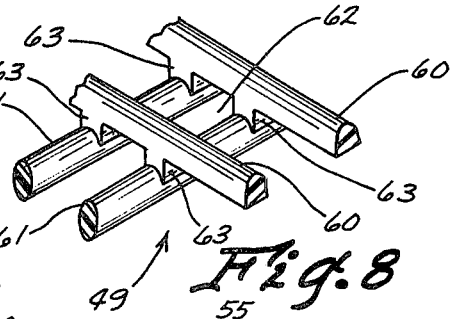
FIG. 8 is a perspective view of the bottom wall gridwork.

The construction of the bottom wall 49 of the silverware basket 15 of the instant invention is shown in FIGS. 5, 6 and 8. These figures show that the bottom wall 49 is made up of a plurality of elongated ribs 60 and 61 which extend the full length and width of the basket 15 in parallel but spaced apart planes to form a plurality of openings or perforations 62 in the bottom wall 49 of the basket 15.

The lengthwise ribs 60 are located in a horizontal plane inside the silverware basket 15 as shown in FIGS. 3 and 4. The cross sectional shape of a typical lengthwise rib 60 is that of a square having a full radiused top or inside as shown in FIG. 6.

The transverse ribs 61 are best shown in cross section in FIG. 5. These ribs 61 can be described as having the shape of an inverted equilateral triangle with a full radius at both the base and the apex.

The parallel, spaced apart, horizontal planes of these longitudinal and lateral elongated ribs 60 and 61 are joined at their apparent projected points of intersection by pillar-like members 63 extending generally transversely between the planes as best shown in the perspective view of FIG. 8. The resulting offset latticework or grid of perforations 62 formed by these ribs 60 and 61 and pillars 63 produces openings or perforations 62 having a non-planar periphery and eliminates any junctions for trapping washing fluid. Further, the offset of the ribs 60 and 61 forming the grid virtually eliminates bridging of the perforations 62 of the grid by the washing fluid. The offset grid thus promotes natural gravitational drainage of the washing fluid from the bottom wall 49 of the silverware basket 15. Although this offset arrangement is shown only on the bottom wall 49 it is anticipated that it could also be incorporated into the side and end wall 34 and 35 construction if desired.

The combination of the tapered vertical ribs 36 and 39 and diagonal ribs 40 of the side walls 34, the sloping sections 51 of the compartment 47 walls 46 and the offset grid of the bottom wall 49 thus provides a unique silverware basket 15 construction which naturally drains washing fluid from its surfaces. The drainage of washing fluid from the basket will enhance the drying capability of the dishwashing apparatus by requiring less washing fluid to be evaporated in the drying portion of the cycle of operations.

In the drawings and specification there is set forth a preferred embodiment of the invention and though specific terms are employed these are used in a generic and descriptive sense only and not for purposes of limitation. Changes in form and the proportion of parts as well as the substitution of equivalents are contemplated as circumstances may suggest or render expedient without departing from the spirit or scope of this invention as defined in the following claims.

I claim:

1. A silverware basket for use in a dishwashing apparatus having perforate bottom and peripheral walls wherein the improvement comprises: means for forming said peripheral walls including a plurality of generally upstanding ribs disposed in a first generally vertical plane and a plurality of downwardly sloping ribs disposed in a generally parallel second plane with said sloping ribs intersecting and connected to said upstanding ribs to form a latticework of perforations around said basket, the surfaces of said sloping ribs being free of horizontal planes and constructed and disposed for draining washing fluid from said basket whereby said latticework is substantially free of horizontal fluid supporting surfaces for minimizing the retention of said washing fluid thereon.

2. A silverware basket for retaining silverware and similar articles in a dishwashing apparatus, comprising: frame means for forming the periphery of said basket; a generally perforate bottom wall for supporting said silverware; and means for enclosing said periphery of said basket within said frame means including first and second pluralities of intersecting ribs disposed in generally vertical, parallel planes and forming a latticework of openings around said periphery, said first plurality of ribs extending generally vertically when said basket is in position for operation in said dishwasher, said second plurality of ribs extending at an angle to said first ribs and being integrally connected to said first ribs at intersecting locations, the surfaces of said first and second pluralities of ribs being free of horizontal planes and constructed and disposed for draining washing fluid from said basket whereby said latticework is substantially free of horizontal fluid supporting surfaces for minimizing the retention of washing fluid thereon.

* * * * *

UNITED STATES PATENT AND TRADEMARK OFFICE

CERTIFICATE OF CORRECTION

PATENT NO. : 4,192,432

DATED : March 11, 1980

INVENTOR(S) : Lawrence J. Jordan

It is certified that error appears in the above—identified patent and that said Letters Patent is hereby corrected as shown below:

Claims 1 and 2 should appear as shown below:

1. A silverware basket for use in a dishwashing apparatus having perforate bottom and peripheral walls wherein the improvement comprises: means for forming said peripheral walls including a plurality of spaced apart generally upstanding ribs having a surface disposed in a generally vertical plane and a plurality of space apart downwardly sloping ribs having a facing surface also disposed in said vertical plane, said sloping ribs having a projected intersecting relationship with said upstanding ribs and connected to said upstanding ribs in said vertical plane at the intersecting positions only to form a latticework of perforations around said basket, said ribs being formed adjacent the intersecting positions so that no part of the rib extends through said vertical plane and the latticework is free of fluid retaining intersections, the surfaces of said sloping It is certified that error appears in the above—identified patent and that said Letters Patent is hereby corrected as shown below:

ribs themselves being free of horizontal planes and constructed and disposed for draining washing fluid from said basket whereby said latticework is substantially free of horizontal fluid supporting surfaces and fluid retaining intersections for minimizing the retention of said washing fluid thereon.

2. A silverware basket for retaining silverware and similar articles in a dishwashing apparatus, comprising: frame means for forming the periphery of said basket; a generally perforate bottom wall for supporting said silverware; and means for enclosing said periphery of said basket within said frame means including first and second pluralities of spaced apart ribs forming in projection a latticework of openings around said periphery, said first plurality of ribs each including a surface in a common plane extending generally vertically when said basket is in

UNITED STATES PATENT AND TRADEMARK OFFICE

CERTIFICATE OF CORRECTION

PATENT NO. : 4,192,432

DATED : March 11, 1980

INVENTOR(S) : Lawrence J. Jordan

It is certified that error appears in the above—identified patent and that said Letters Patent is hereby corrected as shown below:

position for operation in said dishwasher, said second plurality of ribs extending at an angle to said first ribs and each having a facing surface in said vertical plane being integrally connected to said first ribs in said vertical plane at intersecting locations only, said first and second ribs being formed adjacent the intersecting positions so that no part of the rib extends through said vertical plane and the latticework is free of fluid retaining intersections, the surface of said first and second pluralities of ribs themselves being free of horizontal planes and constructed and disposed for draining washing fluid from said basket whereby said

UNITED STATES PATENT AND TRADEMARK OFFICE

CERTIFICATE OF CORRECTION

PATENT NO. : 4,192,432

DATED : March 11, 1980

INVENTOR(S) : Lawrence J. Jordan

It is certified that error appears in the above—identified patent and that said Letters Patent is hereby corrected as shown below:

latticework is substantially free of horizontal fluid supporting surfaces and fluid retaining intersections for minimizing the retention of washing fluid thereon.

Signed and Sealed this

*Eighth* Day of *July 1980*

[SEAL]

*Attest:*

SIDNEY A. DIAMOND

*Attesting Officer* *Commissioner of Patents and Trademarks*